US007076864B2

(12) United States Patent
Malaka

(10) Patent No.: US 7,076,864 B2
(45) Date of Patent: Jul. 18, 2006

(54) RIVETING TOOL

(75) Inventor: Mark D. Malaka, Maple (CA)

(73) Assignee: GBM Rivet & Fasteners Inc., Maple (CA)

( * ) Notice: Subject to any disclaimer, the term of this patent is extended or adjusted under 35 U.S.C. 154(b) by 108 days.

(21) Appl. No.: 10/743,805

(22) Filed: Dec. 24, 2003

(65) Prior Publication Data

US 2004/0168294 A1 Sep. 2, 2004

(30) Foreign Application Priority Data

Jan. 7, 2003 (CA) ..... 2415669

(51) Int. Cl.
*B23P 19/00* (2006.01)

(52) U.S. Cl. ..... 29/798; 29/243.53; 29/243.54; 29/524.1

(58) Field of Classification Search ..... 29/432.2, 29/505, 509, 524.1, 525.05, 525.06, 798, 29/243.53, 243.54; 227/53, 61, 62
See application file for complete search history.

(56) References Cited

U.S. PATENT DOCUMENTS 2,515,674 A * 7/1950 Tisie ..... 29/243.54
2,925,748 A * 2/1960 Ross ..... 29/243.54
3,562,893 A * 2/1971 Winslow et al. ..... 29/243.53
3,747,194 A * 7/1973 Christensen ..... 29/243.54
4,101,064 A * 7/1978 Vargo et al. ..... 227/53
4,854,491 A 8/1989 Stoewer
5,153,978 A * 10/1992 Simmons ..... 29/509
5,279,024 A 1/1994 Zieve et al.
6,735,843 B1 * 5/2004 Campbell et al. ..... 29/525.11

FOREIGN PATENT DOCUMENTS

CA 815206 6/1969

* cited by examiner

*Primary Examiner*—David P. Bryant
*Assistant Examiner*—Jermie E. Cozart

(57) ABSTRACT

A riveting tool for heading rivets includes a riveter die and strike rod which, in use, engages the portion of the rivet shaft which projects beyond the components to head the rivet and produce the formed rivet head. The riveter die includes a head cavity open to a forward end thereof and which has a cavity profile which generally corresponds to a desired geometry of the formed rivet head to be produced. A bore extends longitudinally through the riveter die and opens into a rearward portion of the head cavity. The riveter die bore has a lateral cross-sectional profile corresponding to that of the rivet shaft. The strike rod comprises a longitudinally extending rod which has a lateral cross-sectional shape generally corresponding to that of the rivet shaft. The strike rod is slidably disposed within the riveter die bore so as to be selectively movable relative to the riveter die into engagement with the distal end of the rivet in heading operations. The riveter die is slidable in the axial direction within a support sleeve, so as to enable its rearward movement relative to the strike rod as the strike rod is brought into engagement with the distal end of the rivet shaft.

14 Claims, 7 Drawing Sheets

RIVETING TOOL

SCOPE OF THE INVENTION

The present invention relates to a riveting tool and more particularly, a riveting apparatus and process for the assembly of component parts by means of rivets and similar fasteners which is adapted to produce high quality formed rivet heads, without requiring orbital or radial forming rivet dies.

BACKGROUND OF THE INVENTION

The mechanical attachment of workpiece components such as metal sheets and parts by the use of rivets has been known for some time. Conventionally, rivet holes are predrilled or stamped through two or more components and aligned. A rivet provided with a preformed or premanufactured rivet head and a cylindrical rivet body or shaft is then inserted through rivet holes so that a portion of the rivet shaft projects outwardly beyond the components. Following insertion of the rivet, the preformed head is supported in a support die and the distal end portion of the rivet shaft which projects beyond the components is headed to produce a formed head, sandwiching the components between the formed and premanufactured rivet heads.

Conventionally, the heading of the rivets is performed by either a staking operation or by orbital or radial forming. In staking, a ram driven riveting die is brought into pressure contact with the distal end of the rivet shaft causing the radial deformation of the portion of the shaft which projects beyond the workpiece components. Although the heading of rivets by staking provides a fast and inexpensive method of heading rivets, riveting tools which operate by staking have achieved limited success in controlling the geometry of the formed rivet head.

Increased sophistication of manufacturing processes have more frequently stipulated that formed rivet heads must conform to a specific geometry, as for example, to permit subsequent manufacturing or working of the riveted component parts. To achieve better and more consistent quality of riveted parts, there have been developed processes of heading rivets which involve either the orbital or radial forming of producing a formed rivet head. In orbital forming, a rotating tool holder and shaped tool insert is brought into engagement with the projecting end portion of the rivet shaft. As the rotating tool is brought to bear against the distal end of the rivet, the high speed spinning action of the holder is used to deform the rivet shaft and produce a formed head having a desired shape. Although orbital forming produces a rivet head which may have a uniform predetermined geometry, orbital forming tools are comparatively more expensive and require increased maintenance and riveting production times as compared to conventional staking rivet systems.

The radial formation of a formed rivet head similarly involves a tool holder which is adapted to move through a rosette forming pattern which overlaps the axial centre of the rivet shaft. As a result, the rivet material is spread radially from its axial centre outwardly. As with orbital forming tools, however, radial forming involves the application of complex machinery and increased production times as compared to the heading of rivets by staking.

SUMMARY OF THE INVENTION

The present invention seeks to overcome at least some of the difficulties associated with prior art riveting tools by providing a riveting tool which is adapted to head rivets to produce formed rivet heads having a high quality finish and uniform predetermined geometric shape without the use of complex orbital or radial formed dies.

Another object of the invention is to provide a riveting tool which adapted to support at least part of the portion of the rivet shaft which projects beyond the components during heading operations, so as to achieve at least partial control of its radial deformation as the formed rivet head is produced.

A further object of the invention is to provide an inexpensive and easily manufactured riveting tool which may be used to head a rivet by staking, in which the portion of the rivet shaft which projects beyond the components to be attached is sequentially radially deformed along its projecting length with initial deformation occurring at locations adjacent the components and thereafter at locations successively towards the distalmost end of the rivet shaft.

Another object of the invention is to provide a riveting tool which may be fitted on the end of a robot arm for use in riveting together two, three or more metal sheets.

A further object of the invention is to provide a riveting die for use in a riveting tool which is adapted to produce a formed rivet head in which a distalmost portion of the rivet shaft which is remote from the premanufactured rivet head remains substantially undeformed, so as to facilitate the subsequent attachment of an additional workpiece component thereto.

The present invention relates to a riveting tool for heading conventional solid, semi-solid, or hollow rivets which are used to mechanically secure together two or more workpiece components. The components could, for example, comprise metal sheets or other partially finished goods through which rivet holes are formed. The rivets typically would have a premanufactured rivet head and an elongated rivet shaft which has a radial diameter marginaly less than that of the rivet holes, and which extends axially from the premanufactured head to a distalmost end. The overall axial length of the rivet shaft is selected having regard to the thickness of the workpiece components so that when the rivet shaft is inserted through the aligned rivet holes of two workpieces and the rivet is fully seated with the premanufactured rivet head engaging a first component, the remote distal end of the rivet shaft projects outwardly past the second other component. The tool includes a riveter die and strike rod which, in use, engages the portion of the rivet shaft which projects beyond the components to head the rivet and produce the formed rivet head. The riveter die includes a head cavity which is open to a forward end thereof and which has a cavity profile which generally corresponds to a desired geometry of the formed rivet head to be produced. A bore extends longitudinally through the riveter die and opens into a rearward portion of the head cavity. The riveter die bore has a lateral cross-sectional profile which generally corresponds to that of the rivet shaft, and which is selected to permit at least part of the distal portion of the rivet shaft which projects beyond the components to be received therein in a complementary fit manner. The head cavity may have any number of possible geometric forms depending on the desired final geometric profile of the formed rivet head. Possible cavity shapes would include, without restriction, semi-spherical, frustoconical, semi-elliptical and oblong-elliptical.

The strike rod comprises a longitudinally extending hardened steel or other metal rod which has a lateral cross-sectional shape generally corresponding to that of the rivet shaft. The strike rod is slidably disposed within the riveter die bore so as to be selectively movable relative to the riveter die into engagement with the distal end of the rivet in heading operations. Preferably, the riveter die is slidable in the axial direction within a support sleeve, so as to enable its rearward movement relative to the strike rod as the strike rod is brought into engagement with the distal end of the rivet shaft. Optionally, the riveter die may be resiliently biased, as for example by way of a spring, forwardly into contact against the surface of the second component, so as to ensure close contact between the forward end of the riveter die and component as the rivet is headed.

The riveting tool may also include a support die which is configured to support the premanufactured rivet head and maintain the rivet in a fully seated position during heading operations. In its simplest form, the support die could comprise a fixed plate which may further include one or more recesses which have a complementary profile to that of the preformed head. More preferably, the support die and strike rod are movable by way of a pneumatic, hydraulic and/or motor driven ram in a direction generally aligned with the axis of elongation of the rivet shaft of a fully seated rivet into and/or out of engagement therewith.

In use, the rivet holes in the components to be joined are aligned and a rivet is inserted therethrough and fully seated. The rivet tool is oriented with the axis of the die bore aligned with the axis of the rivet shaft. The riveter die is then positioned in an operating position against the component which is remote from the premanufactured rivet head and over the projecting portion of the rivet shaft so that the projecting distal end portion of the rivet shaft locates within the head cavity and at least partially within the die bore. Preferably, prior to heading at least 20% of the length of the projecting portion of the rivet shaft which extends beyond the components initially locates within the riveter die bore upon initial engagement of the rivet die with the component, and more preferably at least about one-third the length of the projecting portion.

With the riveter die engaging the component, the strike rod is then moved axially along the die bore into engagement with the distal end of the rivet shaft to affect its deformation. Upon initial engagement of the strike rod with the projecting portion of the rivet shaft, the complementary sizing between the riveter die bore and the rivet shaft substantially prevents lateral deformation of the portion of the rivet shaft which is located within the bore while compressing and radially deforming the portion of the rivet shaft which is located in the head cavity. As a result, initial deformation of the rivet shaft occurs within the head cavity, immediately adjacent to the components to be joined.

In the heading of a rivet and the creation of a formed rivet head, the strike rod may be moved relative to the riveter die partway into the head cavity. More preferably, however, the strike rod is limited in moving along the die bore to a forwardmost position so as to be either substantially flush with a rearward portion of the head cavity, or a position spaced rearwardly therefrom. It is to be appreciated that with the latter construction, following the heading of the rivet, the formed rivet head will include a substantially undeformed distalmost shaft-like portion which, for example, could be used in the attachment of a subsequent third component thereto.

Accordingly, in one aspect the present invention resides in a riveting tool for forming a head on a rivet having a preformed rivet head and an elongated rivet shaft which extends longitudinally from the preformed head to a distal end, the tool comprising, a support sleeve having a bore extending axially at least partway therethrough, a riveter die slidably disposed in the bore, the riveter die extending axially from a forward end spaced proximate the rivet to a rearward end remote therefrom and including, a secondary bore extending longitudinally substantially through the riveter die from the rearward end, the secondary bore having a lateral cross-sectional profile generally corresponding to that of the rivet shaft, a head cavity formed in the forward end, the secondary bore being open into a rearward portion of the cavity, the head cavity having a shape generally corresponding to a shape of a preferred formed rivet head and having a size selected such that upon initial engagement of the riveter die with the rivet at least a portion of the rivet shaft locates within the secondary bore so as to be partially constrained against lateral deformation thereby, a strike rod slidably received in the secondary bore, the strike rod being movable relative to the riveter die between a first position wherein a forwardmost face of said rod is located rearwardly from said cavity to a second position located forwardly therefrom, wherein the movement of the rod from the first to the second position engages the distal end of the rivet to compress and laterally deform a portion of the rivet shaft in the head cavity, and a ram being selectively operable to move the strike rod from said first position to said second position.

In another aspect, the present invention resides in a staking rivet tool for securing two workpieces together with a rivet, the rivet including a preformed head and an elongated rivet shaft extending from the preformed head to a distal end, the shaft having a length selected to permit its insertion through aligned rivet apertures formed in each of the workpieces so as to define a projecting end extending therepast, the tool being operable to form a head of the rivet and comprising, a support sleeve having a generally cylindrical bore extending axially at least partway therethrough, a riveter die slidably disposed in the bore, the riveter die extending axially from a forward end for positioning spaced proximate the workpieces to a rearward end remote therefrom and including, a cylindrical secondary bore extending longitudinally through the riveter die from the forward end to the rearward end, the secondary bore having a lateral cross-sectional profile generally corresponding to that of the rivet shaft, a head cavity formed in the forward end, the secondary bore being open into a rearward portion of the head cavity, the head cavity having a shape generally corresponding to a shape of a preferred formed rivet head and having a size selected such that upon initial engagement of the riveter die with the rivet, the projecting end of the rivet shaft locates at least partially within the secondary bore so as to be at least partially constrained against lateral deformation thereby and at least partially in the head cavity, a strike rod slidably received in the secondary bore, the strike rod being selectively movable between a first position wherein a forwardmost face of said rod is spaced rearwardly from said cavity to a second position moved forward therefrom, wherein the movement of the rod to the second position engages the distal end of the rivet to laterally deform the portion of the rivet shaft in the head cavity, and a ram being selectively operable to move the strike rod from said first position to said second position.

In a further aspect, the present invention resides in a method of heading staking a rivet to secure together two workpieces, the workpieces each including a rivet opening formed therethrough, the rivet including a preformed head and an elongated rivet shaft extending axially from the preformed head to a distal end, the shaft having an axial length selected to permit its insertion through the rivet openings of the workpieces when aligned and juxtaposed, so as to define a projecting end extending therepast, the tool comprising, a support sleeve having a generally cylindrical bore extending axially at least partway therethrough, a riveter die slidably disposed in the bore, the riveter die extending axially from a forward end for positioning spaced proximate the workpieces to a rearward end remote therefrom and including, a head cavity formed in the forward end, a cylindrical smaller diameter die bore extending longitudinally through the riveter die substantially from a rearward portion of the head cavity to the rearward end, the secondary bore having a lateral cross-sectional profile generally corresponding to that of the rivet shaft, the head cavity having a shape generally corresponding to a shape of a preferred formed rivet head and having a size selected such that upon initial engagement of the riveter die with the rivet at least a portion of the projecting end of the rivet shaft locates within the secondary bore so as to be at least partially constrained against lateral deformation thereby, a strike rod slidably received in the secondary bore, the strike rod being selectively movable between a first position wherein a forwardmost face of said rod is spaced rearwardly from said cavity to a second position moved forward therefrom, wherein the movement of the rod to the second position engages the distal end of the rivet to compress and laterally deform a portion of the rivet shaft in the head cavity, and a drive being selectively operable to move the strike rod from said first position to said second position, wherein said workpieces are secured to each other by:

positioning the workpieces substantially in juxtaposition with the rivet openings of each workpiece being substantially aligned, inserting the rivet shaft through the openings to move the preformed rivet head into substantial juxtaposed contact with a first of said workpieces, and with the projecting end extending outward beyond the second other workpiece, positioning said riveter die in axial alignment with said rivet shaft, moving said support sleeve axially into initial engagement with said second workpiece to locate at least a portion of said projecting end in said secondary bore, wherein contact with the rivet shaft slides said strike rod to the first position, actuating said drive to move the strike rod forwardly towards said workpieces and said forward position, whereby upon axial compression of the rivet shaft the engagement of the portion of the rivet shaft in the secondary bore with the riveter die substantially prevents its lateral deformation while effecting radial deformation of part of the projecting portion of the rivet shaft in the head cavity to at least partially form a formed rivet head.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
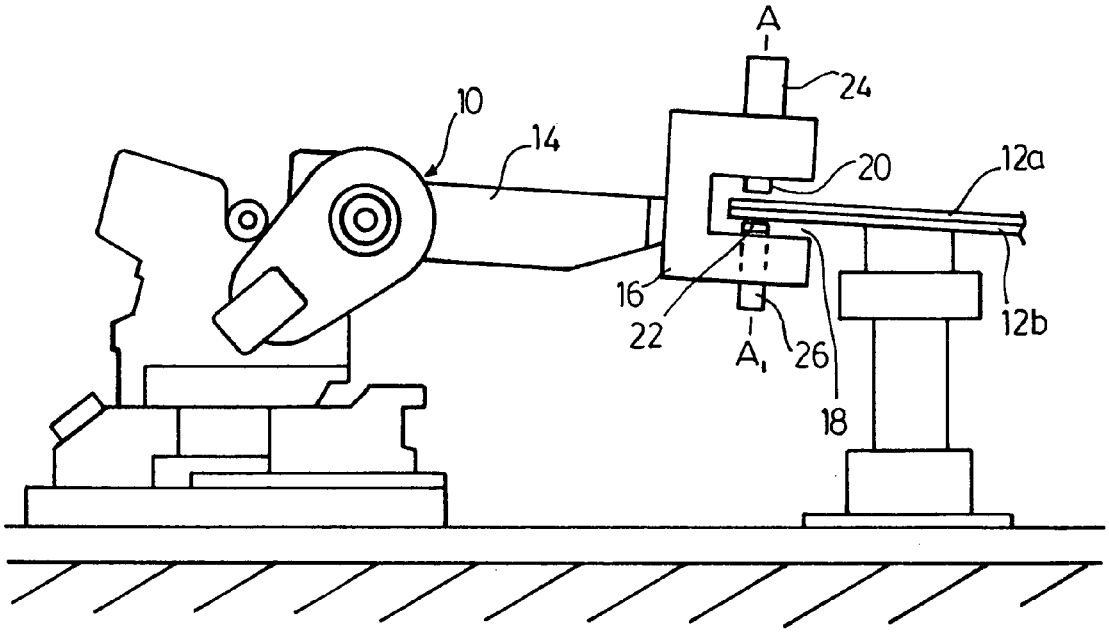
FIG. 1 shows a schematic view of a robot mounted riveting tool used in securing together two metal sheets.

Reference is now made to FIG. 1 which illustrates schematically a robot 10 used in the riveting together of two metal sheet components 12*a*,12*b*. The robot 10 includes a robot arm 14 which is adapted for movement in at least three axis and across a portion of the components 12*a*,12*b* to be joined. A C-frame 16 is secured to an endmost portion of the robot arm 14. The C-frame 16 defines an open throat 18 into which edge portions of the components 12*a*, 12*b* may be received. The C-frame 16 carries on opposing sides of the throat 18 in an axially aligned orientation a staking riveting tool 20 and a rivet support die 22. As will be described hereafter, axially movable hydraulic ram cylinders 24,26 are provided to selectively actuate the riveting tool 20 and support die 22, respectively, in the heading of a solid steel rivet 30 (FIG. 2) to secure the sheet components 12*a*, 12*b* together.

Figure 2:
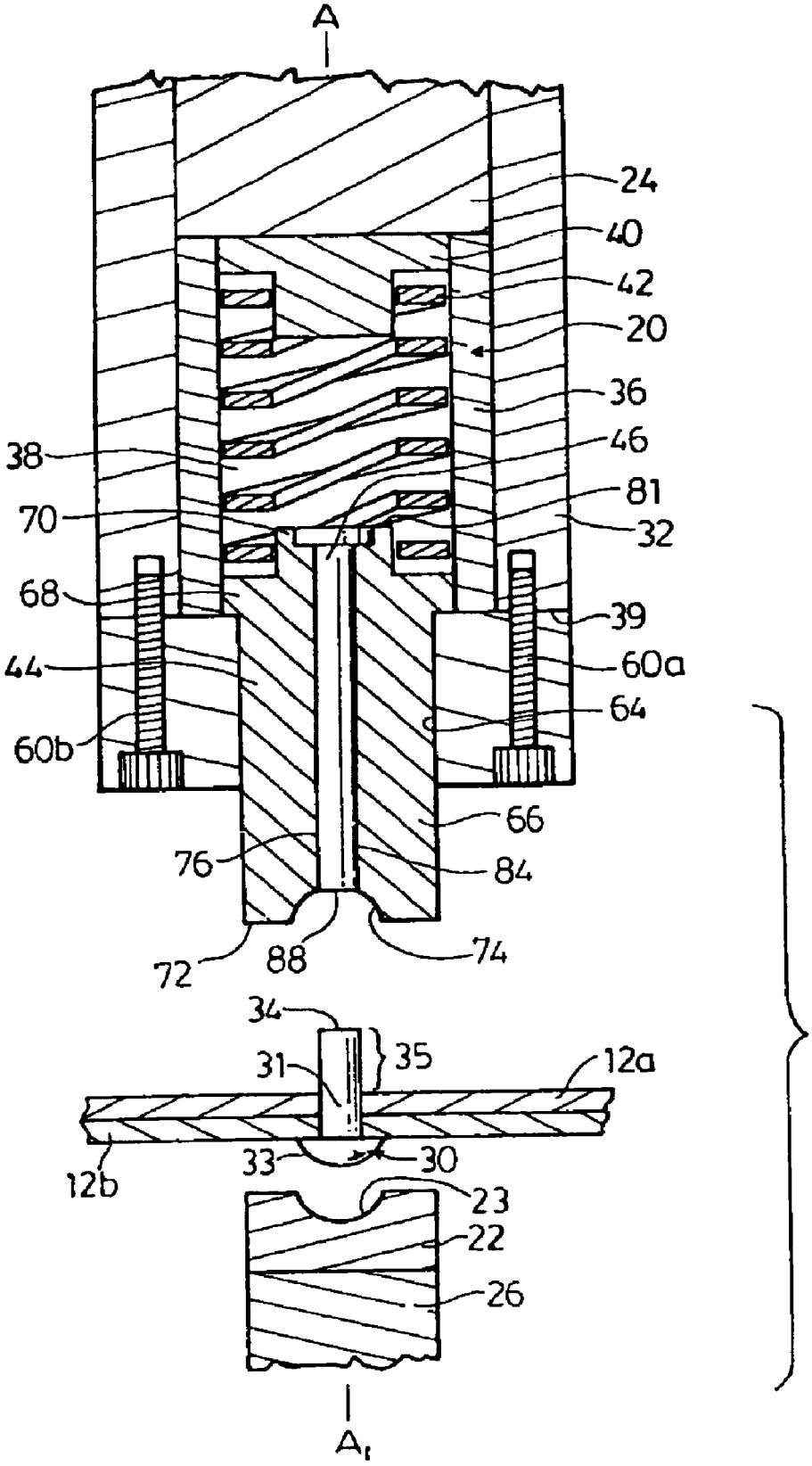
FIG. 2 shows schematically an enlarged view of the riveting tool of FIG. 1 in accordance with a preferred embodiment of the invention following the seating of a rivet to be used in joining two metal sheets.
Figure 3:
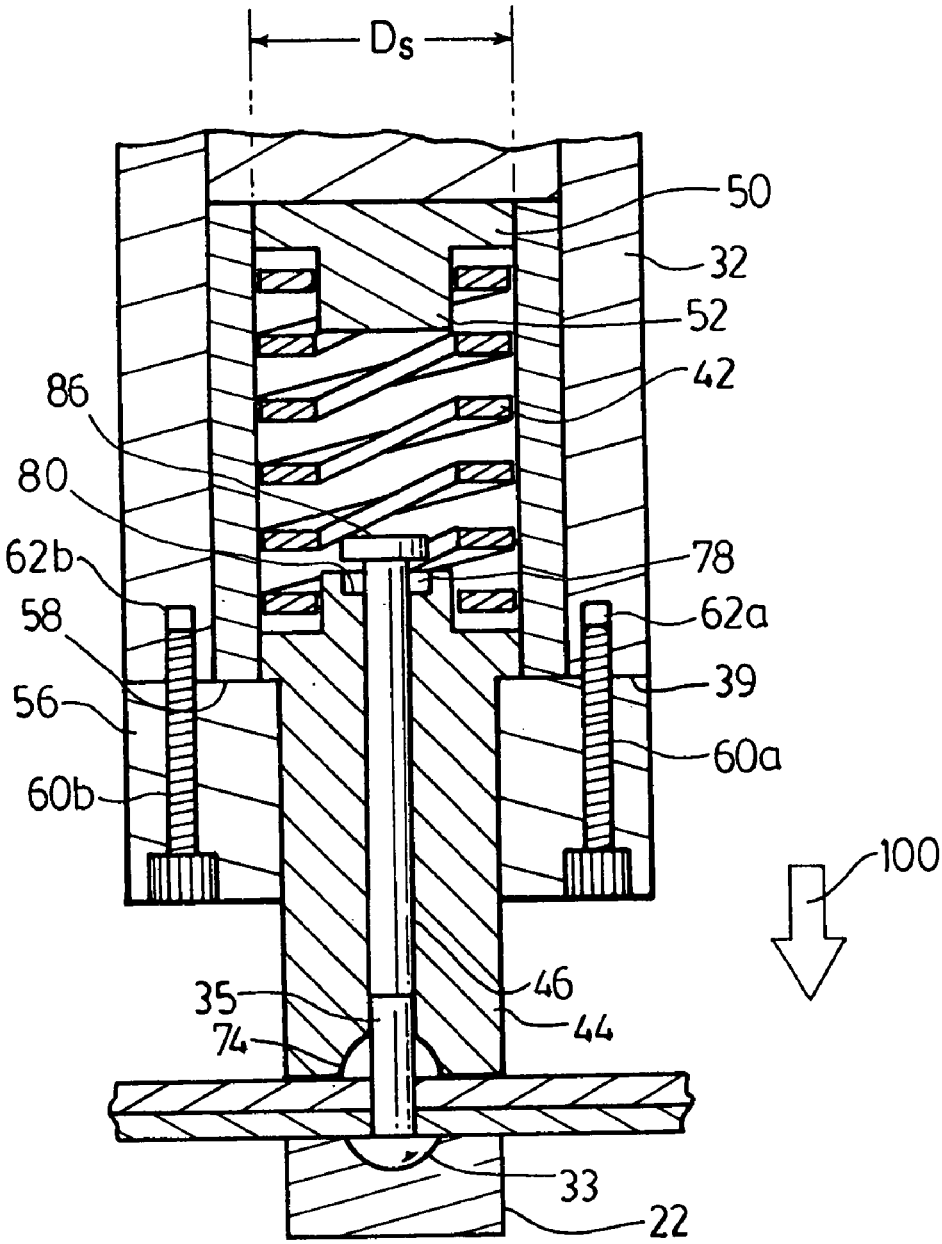
FIG. 3 shows schematically the riveting tool of FIG. 2 positioned in an initial operating position immediately prior to the heading of the rivet.

FIG. 2 illustrates schematically an enlarged view of the riveting tool 20 in accordance with the preferred embodiment of the invention. The riveting tool 20 is secured within a steel mounting bracket 32 which is coupled to a forwardmost end of the hydraulical cylinder 24 for movement therewith in the direction of axis $A–A_1$. The riveting tool 20 includes a hollow steel cylindrical support sleeve 36 which is open at each of its ends and defines a generally cylindrical bore 38 therethrough which is elongated in the direction of axis $A–A_1$ and which has a radial diameter $D_S$ (FIG. 3). As shown best in FIG. 2, the support sleeve 36 has an outer radial dimension sized for complementary insertion within the mounting bracket 32 in a comparatively snug fit. The sleeve 36 has an axial length selected so that when positioned, it is located substantially flush with a forward end 39 of the bracket 32 to substantially eliminate any forces on the sleeve 36 which may act in a direction orthogonal to the axis $A–A_1$ in the operation of the tool 20.

FIGS. 2 and 3 show best a T-button 40, a compressible helical steel spring 42, a riveter die 44 and a strike rod 46 as being at least partially disposed within the bore 38.

The T-button 40 is formed from milled hardened steel and includes a radially extending enlarged diameter rear portion 50 and a smaller diameter cylindrical knob 52 which projects in the axial direction forwardly therefrom. The diameter of the rear portion 50 is selected marginally less than diameter $D_S$ to enable the fitted placement of the T-button 40 within the bore 38 with the sleeve 36 to close its rearwardmost end.

The button 40 and support sleeve 36 are engaged along their rear surfaces by the hydraulic ram cylinder 24 for movement along the axis $A–A_1$ therewith. The knob 52 extends radially about the axis $A–A_1$ and has a lateral dimension selected less than the open interior diameter of the spring 42 so as to be insertable therein.

The support sleeve 36 is coupled to the ram cylinder 24 for movement therewith by a retaining ring 56. The retaining ring 56 extends across the front edge 58 of the support sleeve 36 and the forward end 39 of the mounting bracket 32. A series of threaded bolts 60*a*,60*b* are insertable through bores formed in the retaining ring 56 for threaded engagement with internally threaded sockets 62*a*,62*b* formed axially in the end 39 of the bracket. The retaining ring 56 is provided with an axial centered circular opening 64 which has a dimension $D_R$ (FIG. 4) selected less than the radial dimension $D_S$ of the support sleeve bore 38.

Figure 4:
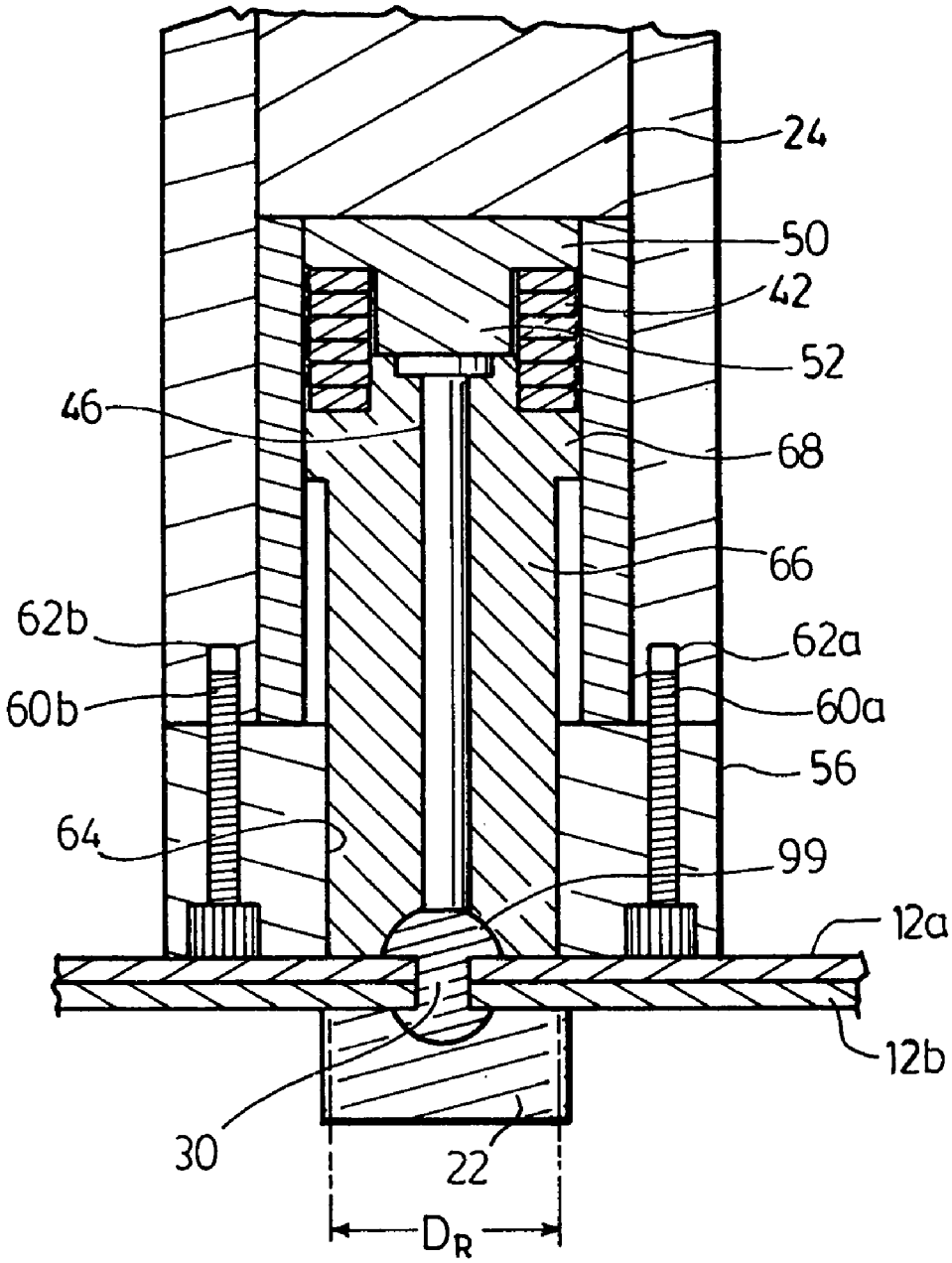
FIG. 4 shows the riveting tool of FIG. 2 showing the full compression of the riveter die and the heading of the rivet.

FIGS. 2 to 4 show best the riveter die 44 as being slidably disposed at least partially within the sleeve bore 38. A forwardmost portion of the riveter die 44 is formed as a cylindrical body portion 66 which has a radial diameter which is marginally less than the diameter $D_R$ of the retaining ring opening 64 so as to enable its sliding insertion therethrough. The body portion 66 has an axial length greater than that of the retaining ring 56 and merges rearwardly with an enlarged diameter, radially outwardly extending flange 68 which extends radially to the support sleeve. It is to be appreciated that when the retaining ring 56 is secured to the mounting bracket 32 for example in the manner shown in FIG. 2, the engagement of the flange 68 with the retaining ring 56 limits forward sliding movement of the riveter die 44 preventing its further withdrawal from the support sleeve 36. Preferably, the riveter die 44 also includes a cylindrical projection 70 extending axially rearward from the flange 68. The cylindrical projection 70 has a diameter selected less than the open interior of the spring 42 so as to be insertable therein.

As will be described, with the illustrated configuration, each end of the spring 42 is provided in resilient engaging contact with the rear portion 50 of the T-button 40 and the flange 68 of the riveter die 44. As shown best in FIG. 1, the helical spring 42 resiliently biases the riveter die 44 relative to the support sleeve 36 towards an initial position with the radial flange 68 engaging the retaining ring 56. Although not essential, most preferably the helical spring 42 has a spring coil diameter selected to enable engaging contact between the knob 52 of the T-button 40 and the cylindrical projection 70 of the die 44 upon sliding movement of the die 44 rearwardly relative to the sleeve 36 against the bias of the spring 42.

FIG. 2 shows best the riveter die 44 as further including in its forwardmost end 72 a head cavity 74. The head cavity 74 is preferably formed symmetrically about the axis $A–A_1$ having a cross-sectional profile which is generally semi-elliptical and selected to generally correspond to the desired finished profile of a formed rivet head. A second generally cylindrical die bore 76 extends longitudinally through the riveter die aligned with the axis $A–A_1$. The die bore 76 opens into a rearward portion of the head cavity 74 and most preferably has a lateral cross-sectional size and profile which corresponds to that of the shaft 31 of the rivet 30. As seen best in FIG. 3, at its rearwardmost end, the riveter die bore 76 is provided with a radially enlarged portion 78 which is open to the rearwardmost end 81 of the cylindrical projection 70, and which forms a radially extending shoulder 80.

FIGS. 2 to 4 show best the strike rod 46 used in the riveting tool 20. The strike rod 46 is formed from hardened steel or other suitable metal and includes a cylindrical rod portion 84 and an enlarged diameter head 86. The cylindrical rod portion 84 is sized for sliding insertion within the bore 76 and most preferably has a lateral cross-sectional dimension generally corresponding to that of the shaft 31 of the rivet 30 which is to be used to join the sheets 12*a*,12*b*. The head 86 diameter has an axial length and radial dimension selected to enable its engagement with the shoulder 80 and within the radially enlarged portion 78 of the bore 76. Although not essential, most preferably, the enlarged head 86 of the strike rod 46 is formed with an axial length selected to enable the rod 46 to be seated flush with the rearwardmost end 81 of the riveter die 44. The strike rod 46 has an overall axial length which is preferably selected so that when fully so seated, the forward end 88 of the strike rod 46 either locates immediately adjacent to or is spaced rearwardly from the head cavity 74. More preferably, the strike rod 46 has an axial length which is equal to or less than the axial length of the die bore 76 and which, in assembly of the tool 20, is greater than the maximum distance between the rearward end 81 of the riveter die 44 and a forwardmost end of the T-button 40, so as to prevent removal of the strike rod 46 from the die bore 76 once the riveting tool 20 has been assembled.

As shown best in FIG. 3, the support die 22 is adapted to engagingly support the premanufactured head 33 of the rivet 30. The support die 22 typically includes a recess 23 (FIG. 2) having a cross-sectional profile generally corresponding to that of the rivet head 33 and is selectively movable in the axial direction by the selective activation of the hydraulic ram cylinder 26.

FIGS. 2 to 4 show best the operation of the riveting tool 20 in mechanically securing the component metal sheets 12*a*,12*b* together by means of the formed rivet 30. In particular, the robot 10 is operable for use with a conventional solid steel rivet 30 in which the cylindrical rivet shaft 31 extends along the axis $A–A_1$ from the premanufactured rivet head 33 to a distalmost end 34. The robot 10 is operable to head a projecting portion 35 (FIG. 2) of the rivet shaft 31 which projects beyond the workpiece 12*a* once the rivet 30 is fully seated within aligned rivet holes formed in the workpieces 12*a*,12*b* with the rivet head 33 moved against the forwardmost component 12*b*.

The operation of the riveting tool 20 is best described with reference to FIGS. 2 to 4. To couple the workpiece sheets 12*a*, 12*b* together, the sheets 12*a*, 12*b* are initially placed with the rivet holes which have formed therethrough aligned. The rivet 30 is then positioned in the seated position with the rivet shaft 31 extending through the aligned holes and the premanufactured rivet head 33 engaging the forwardmost workpiece component 12.

Following the seating of the rivet 30, the robot arm 14 is positioned to move the C-frame 16 so that the riveter die 44, support die 22 and rivet shaft 31 are each co-axially aligned in the manner shown in FIG. 2.

The support die 22 is then moved against the workpiece 12*b* in the manner shown in FIG. 3 by the movement of the ram cylinder 26 inwardly into the C-frame throat 18 towards the workpiece 12*b*, thereby locating the premanufactured rivet head 33 in supported position within the recess 23.

The ram cylinder 24 is next activated to move the riveter die 44 axially towards the support die 22 where upon it contacts the workpiece 12*a* in an initial operating position. As the riveter die 44 initially moves against the workpiece 12*a*, the distal end 34 of the rivet shaft 31 locates in the second die bore 76. Because the strike rod 46 is freely slidable within the die bore 76, the engagement of the distal end 34 with the forward end 88 of the rod 46 results in its dislocation relative to the die 44 rearwardly towards the T-button 40 in the position shown in FIG. 3.

Following the locating of the rivet shaft 31 in the initial operating position shown in FIG. 3, the ram cylinder 24 continues forward movement of the mounting bracket 32 and support sleeve 36, in the forward direction of arrow 100 (FIG. 3) towards the sheet 12*a*. The forward movement of the cylinder 24 and the engagement between the riveter die 44 and sheet 12*a* results in the riveter die 44 moving rearwardly relative to T-button 40 and sleeve 36 against the compression of the spring 42. As the riveter die 44 moves relative to the support sleeve 36, the knob 52 is brought first into engagement with the head 86 of the strike rod 46. Upon initial contact between the T-button 40 and the strike rod 46, the rod 46 is urged forwardly towards the workpiece 12*a* engaging the distal end 34 of the rivet 30 and radially deforming the rivet shaft 31 by staking. It is to be appreciated that insofar as a distal endmost portion of the rivet shaft 31 is initially located within the die bore 76, the complementary sizing of the die bore 76 and shaft 3 acts to substantially prevent lateral deformation of the portion of the rivet shaft 31 which is disposed therein. As such, initial radial deformation of the rivet shaft 31 occurs along the portion of the rivet shaft 31 which is located in the head cavity 74 and which is immediately adjacent to the workpiece 12*a*. Deformation of the rivet shaft 31 immediately adjacent to the workpiece 12*a* occurs with the portion 130 of the rivet 30 which initially locates within the bore 76 successively being forced into and deforming radially head cavity 74, filling it to its predetermined profile as the T-button 40 moves the strike rod 46 along the second bore 76. Although not essential, most preferably, the cylinder 24 effects relative movement of the riveter die 44 and strike rod 46 until the strike rod 46 is located fully recessed within the die bore 76 and the end 86 of the rod 46 and rearwardmost end 81 of the die 44 are brought into bearing contact with the T-button 40. More preferably, with this configuration the forward end 88 of the strike rod 46 is located flush with the rear of the cavity 74 with the result that the rivet 30 is provided with a formed head 99 (FIG. 4) having the desired geometric appearance.

Figure 5:
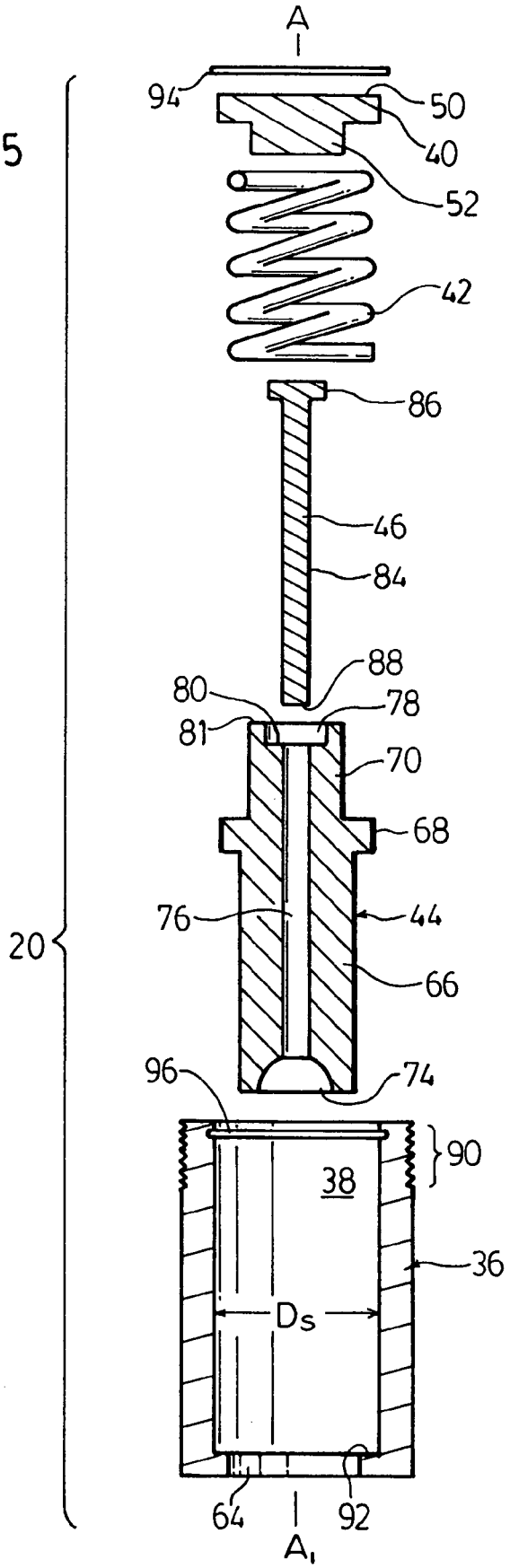
FIG. 5 illustrates an exploded view of a riveting tool in accordance with a second embodiment of the invention.

Preference may be had to FIG. 5 which shows an exploded view of a riveting tool 20 in accordance with a second embodiment of the invention, in which like reference numerals are used to identify like components. The riveting tool of FIG. 5 is adapted to be secured directly to a movable robot arm (not shown) in a threaded-fit arrangement. In this regard, as shown best in FIG. 6 the rearward peripheral surface of the support sleeve 36 is provided with external helical threads 90. The helical threads 90 are configured for threaded engagement within an internally threaded socket (not shown) in the robot arm, so as to facilitate simplified insertion and removal of the riveting tool 20 in the event of ware or failure of the riveter die 44 or strike rod 46.

Figure 6:
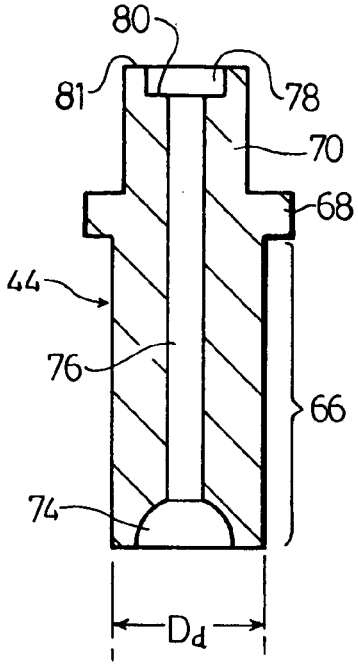
FIG. 6 illustrates an enlarged cross-sectional view of the riveter die used in the riveting tool of FIG. 5.

As shown best in FIGS. 5 and 6, the support sleeve 36 is provided with a radially extending lip 92 which projects inwardly towards the axis $A–A_1$. The lip 92 is provided in place of the retaining ring 56 of FIG. 2 and defines an axially centered opening 64 having a diameter $D_R$ which is marginally larger than the diameter $D_d$ of the cylindrical body portion 66 (FIG. 6) of the riveting die 44. As with the retaining ring 56 of FIG. 2, the inwardly extending flange 92 of the sleeve 36 is sized for engaging contact with the flange 68 of the riveting die 44 to limit its movement forwardly from the forward end of the die 44.

Figure 7:
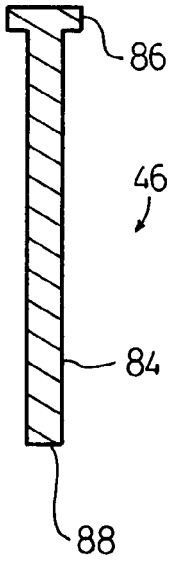
FIG. 7 illustrates a cross-sectional view of the strike rod used in the riveting tool of FIG. 5.
Figure 8:
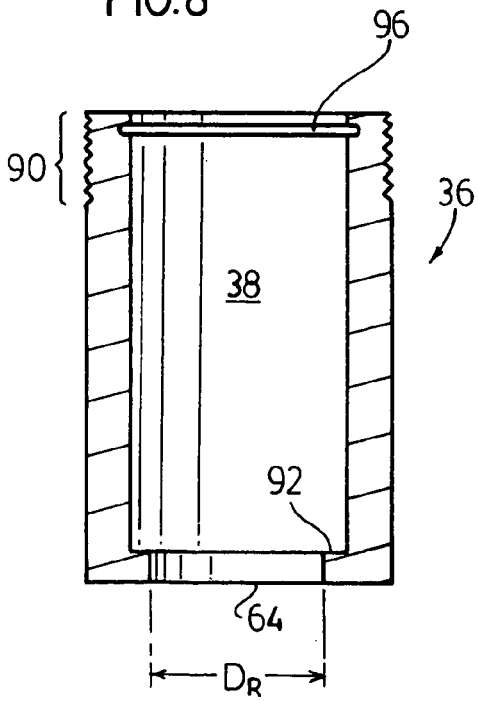
FIG. 8 illustrates a cross-sectional view of the support sleeve used in the riveting tool of FIG. 4.

The riveting tool 20 is assembled by inserting the riveting die 44 through the open rearward end of the support sleeve 36. Thereafter, the strike rod 46 (FIG. 7) is inserted rearwardly into the riveting die bore 76 and the compressible helical spring 42 is inserted into the cylindrical bore 38 of the sleeve 36. The spring 42 being maintained partially under pressure, sandwiched between the T-button 40 and die flange 68. The tool 20 is maintained in assembly by the use of a resiliently compressible C-clip 94 (FIG. 5) which engages a rearmost surface of the T-button 40 and which is sized for mated insertion within an annular groove 96 formed about a rearward portion of the interior of the sleeve 36.

Figure 9A:
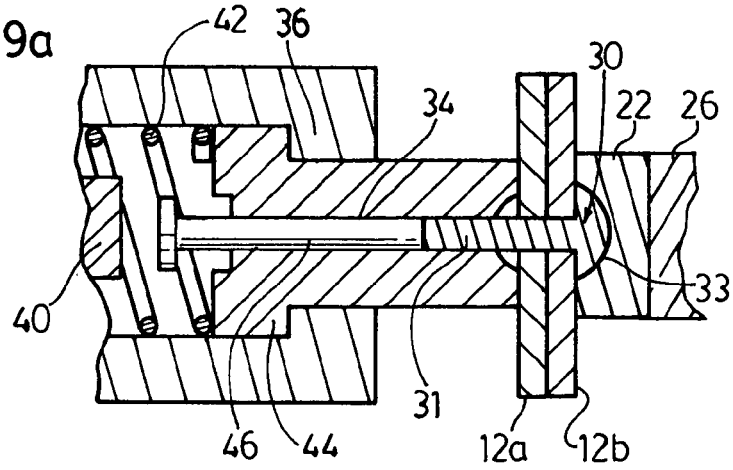
FIGS. 9*a*, 9*b* and 9*c* illustrate schematically the manner of using the riveting tool of FIG. 5 to head a rivet in accordance with a further method of the present invention.
Figure 9B:
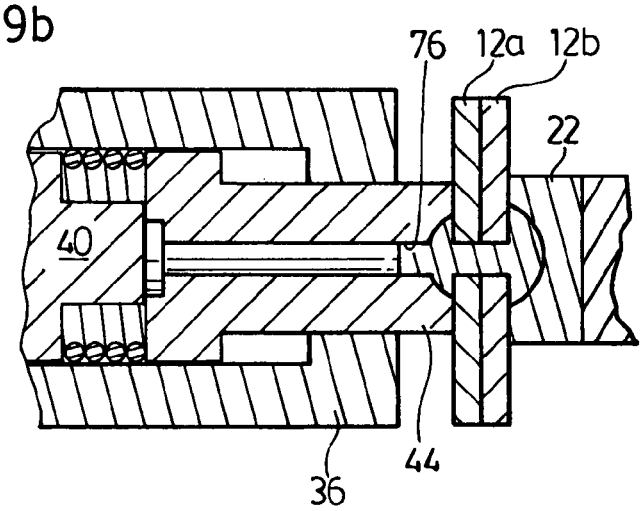
Figure 9C:
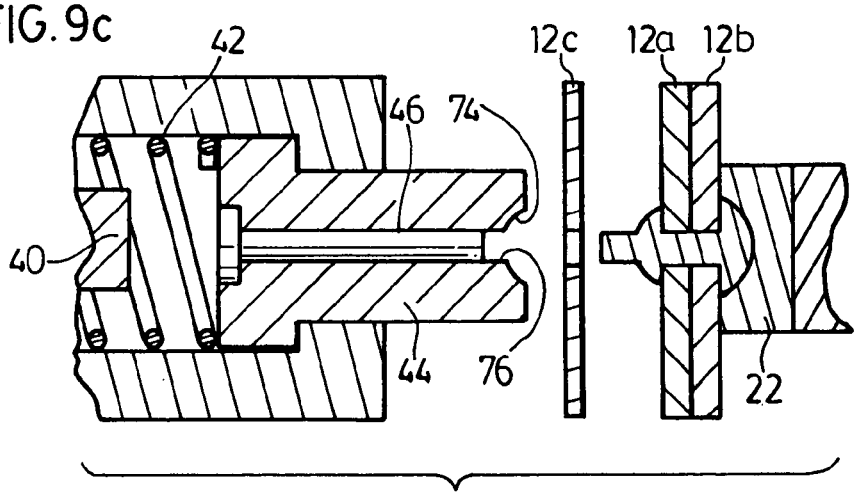

FIGS. 9*a*, 9*b* and 9*c* illustrate the operation of the riveting tool 20 of FIG. 5 in the heading of a rivet 30 used to secure together three sheet components 12*a*, 12*b*, 12*c*. In securing more than two workpiece components 12*a*,12*b*, a rivet 30 is selected having a rivet shaft 31 construction which is longer in the axial direction as compared to the rivet construction required to secure two workpiece components.

As with the first embodiment, initially two workpiece components 12*a*, 12*b* are positioned with their rivet openings aligned, and a rivet 30 is seated therethrough such that its preformed head engages the forwardmost workpiece 12*b*. The premanufactured rivet head is thereafter engageably supported by a support die 22 by moving the ram cylinder 26 towards the workpiece sheet 12*b*. The robot arm (not shown) is then moved by means of hydraulic and/or pneumatic cylinders to axially align the bore 76 of the die 44 with the axis of the rivet shaft. Following initial positioning, the forward end of the riveting die 44 is moved forwardly against the rearwardmost sheet 12*a* to an initial operating position, as for example is shown in FIG. 9*a*. The engagement of the distal end 34 of the rivet 30 with the end 88 (FIG. 7) of the strike rod 46 initially slide the rod 46 rearwardly relative to the die 44 and support sleeve 36. As the riveting die 44 is moved by the robot arm forwardly towards the workpiece 12*a*, contact between the workpiece 12*a* and riveter die 44 causes the die 44 to be slid rearwardly relative to the sleeve 36 and T-button 40 against the bias of the spring 46. As the riveter die 44 moves rearwardly relative to the T-button 40, the T-button 40 first engages the strike rod 46 in forward movement. The distal end 34 of the rivet shaft is thus contacted by the forward end 88 of the strike rod 46 as it is moved forward, resulting in its compression and radial deformation.

As shown in FIG. 9*b*; as the riveting tool 10 is moved forwardly towards the workpieces 12*a*,12*b*, the riveter die 44 moves rearwardly relative to the support sleeve 36 against the bias of the spring 42 until the T-button 40 engages the rear end 81 (FIG. 6) of the riveter die 44 and slides the strike rod 46 fully within the bore 76. As with the previous embodiment., the portion of the rivet shaft 31 which locates within the die bore 76 remains substantially undeformed as a result of its support and confinement by the sidewalls of the bore 76. The portion of the rivet shaft 31 which extends outwardly beyond the workpiece component 12*a* and within the head cavity deforms radially outwardly, with the rivet shaft material being compressed by the strike rod 46 into the head cavity 74 to form a desired rivet head, securing the workpieces 12*a*, 12*b* together.

As shown best in FIG. 9*c*, with the full compression of the strike rod 76 into the recess 78 formed in the rear of the riveter die 44, and the engagement of the T-button 40 against the strike rod end 86 and die end 81, the forward end 88 of the strike rod 46 locates within the die bore 76 a distance spaced rearwardly from the head cavity 74. Similarly, a distalmost end 34 of the rivet shaft 31 also remains partially located within the die bore 76, and substantially undeformed. As a result, following removal of the rivet tool 20, a third workpiece sheet 12*c* may be secured over the remaining undeformed portion of the rivet 30 for attachment to the workpiece sheet 12*a*, 12*b* by further staking operations.

It is to be appreciated that with the present invention, a formed rivet head may be produced having a desired geometric shape by comparatively simple staking operation, as contrasted with either orbital or radial rivet head forming processes. As such, the present invention is suitable for use with conventional staked rivet production systems without substantive modification.

Although the preferred embodiment of the invention illustrates the riveting die 44 as being operable to produce a formed rivet head 99 having a generally dome shaped geometric shape, the invention is not so limited. It is to be appreciated that a variety of other shaped rivet heads including semi-spherical, triangular, conical or oblong shapes are also possible depending upon the desired finish.

Similarly, although the preferred embodiment of the invention illustrates the riveting tool as being used with a solid steel rivet 30, the invention is not so limited. The present invention is equally suitable for use with semi-tubular or tubular rivets, depending upon the desired head configuration.

In the preferred embodiments, the riveting tool 20 is illustrated as being coupled directly to the hydraulic cylinder 24 or robot arm for movement therewith. It is to be appreciated that the invention is not so limited. In an alternate construction, the tool 20 could for example be secured to the end of other drive shaft or arms which are either pneumatically or otherwise motor driven so as to function in essentially the same manner as the hydraulic ram 24 shown in FIG. 1.

Although FIG. 5 describes the riveting tool 20 as being coupled to a robot arm through the use of the external helical threads on the support sleeve, it is to be appreciated that other mechanical fasteners and methods of connecting the riveting tool 20 in the desired position will now become apparent.

Although the detailed description describes and illustrates various preferred embodiments, the invention is not so limited. Many modifications and variations will now occur to persons skilled in the art. For a definition of the invention, reference may be had to the appended claims.

I claim:

1. A riveting tool for forming a head on a rivet having a preformed rivet head and an elongated rivet shaft which extends longitudinally from the preformed head to a distal end, the tool comprising:

a support sleeve having a bore extending axially at least partway therethrough, a riveter die slidably disposed in the bore, the riveter die extending axially from a forward end spaced proximate the rivet to a rearward end remote therefrom and including, a secondary bore extending longitudinally substantially through the riveter die from the rearward end, the secondary bore having a lateral cross-sectional profile generally corresponding to that of the rivet shaft, a head cavity formed in the forward end, the secondary bore being open into a rearward portion of the cavity, the head cavity having a shape generally corresponding to a shape of a preferred formed rivet head and having a size selected such that upon initial engagement of the riveter die with the rivet at least a portion of the rivet shaft locates within the secondary bore so as to be partially constrained against lateral deformation thereby, a strike rod slidably received in the secondary bore, the strike rod being movable relative to the riveter die between a first position wherein a forwardmost face of said rod is located rearwardly from said cavity to a second position located forwardly therefrom, wherein the movement of the rod from the first to the second position engages the distal end of the rivet to compress and laterally deform a portion of the rivet shaft in the head cavity, and a ram being selectively operable to move the strike rod from said first position to said second position.

2. A tool as claimed in claim 1 wherein said riveter die is movable between an extended position wherein said forward end is located forwardly so as to extend relative to said sleeve and a retracted position wherein said riveter die is moved rearwardly therefrom, the tool further including, a retaining member for limiting forward movement of the riveter die relative to the support sleeve past said extended position, and a biasing member for resiliently biasing said riveter die to said extended position.

3. A tool as claimed in claim 2 wherein said strike rod is slidable within the second bore, the rod further including a retaining flange for limiting its forward sliding movement relative to said riveter die, when the riveter die is in the extended position, the strike rod being slidable such that the engagement of the distal end of the rivet with the forwardmost face substantially relocates the rod to the first position.

4. The tool as claimed in claim 3 wherein the retaining flange substantially prevents sliding movement of forwardmost face of the strike rod forwardly into the cavity.

5. The tool as claimed in claim 4 wherein in said second position said strike rod extends in said riveter die along said secondary bore substantially from rearward portion of said cavity to said rearward end of said riveter die.

6. A tool as claimed in claim 5 further including a button head support die sized to engagingly receive therein said preformed head, said button head die being configured to support and substantially prevent movement of said preformed head during operation of said ram.

7. A tool as claimed in claim 5 wherein the ram is operable to move the support sleeve, riveter die and strike rod forwardly relative to the rivet, the tool further including a closure member engaging said support sleeve and being located a maximum distance rearwardly of the strike rod and riveter die, the closure member limiting rearward movement of the riveting die and the striking rod relative to the support sleeve, and wherein said strike rod has an axial length selected greater than said maximum distance.

8. A tool as claimed in claim 5 further including an axially movable robot arm for positioning said tool with said secondary bore in substantial axial alignment with the shaft of a selected rivet, said support sleeve further comprises helical threads for removably coupling said sleeve to said arm for movement therewith.

9. A staking rivet tool for securing two workpieces together with a rivet, the rivet including a preformed head and an elongated rivet shaft extending from the preformed head to a distal end, the shaft having a length selected to permit its insertion through aligned rivet apertures formed in each of the workpieces so as to define a projecting end extending therepast, the tool being operable to form a head of the rivet and comprising:

a support sleeve having a generally cylindrical bore extending axially at least partway therethrough, a riveter die slidably disposed in the bore, the riveter die extending axially from a forward end for positioning spaced proximate the workpieces to a rearward end remote therefrom and including, a cylindrical secondary bore extending longitudinally through the riveter die from the forward end to the rearward end, the secondary bore having a lateral cross-sectional profile generally corresponding to that of the rivet shaft, a head cavity formed in the forward end, the secondary bore being open into a rearward portion of the head cavity, the head cavity having a shape generally corresponding to a shape of a preferred formed rivet head and having a size selected such that upon initial engagement of the riveter die with the rivet, the projecting end of the rivet shaft locates at least partially within the secondary bore so as to be at least partially constrained against lateral deformation thereby and at least partially in the head cavity, a strike rod slidably received in the secondary bore, the strike rod being selectively movable between a first position wherein a forwardmost face of said rod is spaced rearwardly from said cavity to a second position moved forward therefrom, wherein the movement of the rod to the second position engages the distal end of the rivet to laterally deform the portion of the rivet shaft in the head cavity, and a ram being selectively operable to move the strike rod from said first position to said second position.

10. The tool as claimed in claim 9 wherein said cavity is formed having a dimension selected whereby upon the initial engagement of the riveter die with a workpiece at least about one third of the projecting end of the rivet shaft locates within the secondary bore so as to be partially constrained against lateral deformation thereby.

11. A tool as claimed in claim 9 wherein said riveter die is movable relative to the sleeve between an extended position wherein said forward end is moved forwardly so as to extend forwardly past to a front end of said sleeve and a retracted position wherein said forward end of the riveter die is moved rearwardly substantially flush with the front end, the sleeve further including a retaining member for limiting forward movement of the riveter die past said extended position, a biasing spring for resiliently biasing said riveter die to said extended position, and wherein the strike rod includes a retaining flange for limiting its forward sliding movement relative to said riveting die, when the riveter die is in the extended position, the strike rod being slidable such that the engagement of the distal end of the rivet with the forwardmost face substantially relocates the strike rod to the first position.

12. The tool as claimed in claim 11 wherein the retaining flange substantially prevents sliding movement of forwardmost face of the strike rod forwardly into the cavity, and whereby in said second position said strike rod extends in said riveter die along said secondary bore substantially from rearward portion of said cavity to said rearward end of said riveter die.

13. A tool as claimed in claim 9 wherein the ram is operable to move the support sleeve, riveter die and strike rod forwardly relative to the workpieces, the tool further including a closure member and being located a distance rearwardly of the strike rod and riveter die, the closure member engaging and limiting rearward movement of the riveting die and the striking rod relative to the support sleeve as the support sleeve is moved towards the workpiece.

14. A tool as claimed in claim 13 further including an axially movable robot arm for positioning said tool with said secondary bore in substantial axial alignment with the projecting end of the rivet, said support sleeve further comprises a mechanical coupler for removably coupling said sleeve to said arm for movement therewith.

* * * * *